US009962930B2

(12) United States Patent
Sasaki et al.

(10) Patent No.: US 9,962,930 B2
(45) Date of Patent: May 8, 2018

(54) PRINTING APPARATUS AND PRINTING METHOD

(71) Applicant: SEIKO EPSON CORPORATION, Tokyo (JP)

(72) Inventors: Tsutomu Sasaki, Matsumoto (JP); Satoru Katagami, Matsumoto (JP); Kazuyoshi Tanase, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/441,045

(22) Filed: Feb. 23, 2017

(65) Prior Publication Data

US 2017/0239938 A1 Aug. 24, 2017

(30) Foreign Application Priority Data

Feb. 24, 2016 (JP) ..... 2016-032730

(51) Int. Cl.
*B41J 2/015* (2006.01)
*B41J 2/045* (2006.01)
*B41J 2/21* (2006.01)

(52) U.S. Cl.
CPC ..... *B41J 2/04535* (2013.01); *B41J 2/04586* (2013.01); *B41J 2/2114* (2013.01)

(58) Field of Classification Search
CPC ..... B41J 2/04535; B41J 2/04586; B41J 2/07; B41J 29/38; B41J 3/28
USPC ..... 347/9, 14, 15, 20, 21, 40, 43; 358/3.01, 358/3.06, 3.13
See application file for complete search history.

(56) References Cited

U.S. PATENT DOCUMENTS

| | | | |
|---|---|---|---|
| 2006/0214966 | A1 | 9/2006 | Tatsumi |
| 2007/0064026 | A1 | 3/2007 | Hirakawa |
| 2012/0320119 | A1 | 12/2012 | Sonehara |
| 2014/0146104 | A1 | 5/2014 | Sonehara |

FOREIGN PATENT DOCUMENTS

| | | |
|---|---|---|
| EP | 0847872 A | 6/1998 |
| JP | 2007-106117 | 4/2007 |
| JP | 2008-257394 | 10/2008 |
| JP | 2013-000997 | 1/2013 |
| JP | 2015-134460 | 7/2015 |

*Primary Examiner* — An Do
(74) *Attorney, Agent, or Firm* — Workman Nydegger

(57) ABSTRACT

A printing apparatus includes a reaction liquid application portion that applies dots of reaction liquid onto a recording medium by applying the reaction liquid to pixels in a pixel array in which rasters in which a plurality of pixels are lined up in a first direction are lined up in a second direction which is orthogonal to the first direction and an ink application portion that applies ink dots to the recording medium by applying ink which includes a color material that is coagulated using an action of the reaction liquid to the pixels of the pixel array, in which the reaction liquid application portion applies the reaction liquid dots by being separated by one pixel or more in the first direction and the second direction.

7 Claims, 8 Drawing Sheets

PRINTING APPARATUS AND PRINTING METHOD

BACKGROUND

1. Technical Field

The present invention relates to a technique in which an image is printed by applying reaction liquid onto a recording medium and then applying ink, which includes color material that is coagulated using the reaction liquid, onto the recording medium.

2. Related Art

A printing apparatus (image forming apparatus) in JP-A-2007-106117 discharges reaction liquid (processing liquid), in which color material included in the ink is coagulated, onto a recording medium and then discharges the ink onto the recording medium. The printing apparatus is able to coagulate color material of the ink that is discharged onto the recording medium using the reaction liquid and quickly fix the color material of the ink onto the recording medium.

However, in the printing apparatus that uses reaction liquid, adjacent dots of the reaction liquid may converge into one large cluster on a recording medium. Then, when color material of the ink coagulates due to the cluster of the reaction liquid, there is a concern that a defect is caused such as, for example, line width of a printed image becoming partially thick and image quality worsens.

SUMMARY

An advantage of some aspects of the invention is to provide a technique which is able to suppress worsening of image quality.

The invention can be realized in the following aspects.

According to an aspect of the invention, there is provided a printing apparatus including a reaction liquid application portion that applies dots of reaction liquid onto a recording medium by applying the reaction liquid to pixels in a pixel array in which rasters in which a plurality of pixels are lined up in a first direction are lined up in a second direction which is orthogonal to the first direction and an ink application portion that applies ink dots to the recording medium by applying ink which includes a color material that is coagulated using an action of the reaction liquid to the pixels of the pixel array, in which the reaction liquid application portion applies the reaction liquid dots by being separated by one pixel or more in the first direction and the second direction.

According to another aspect of the invention, there is provided a printing method including applying dots of reaction liquid onto a recording medium by applying the reaction liquid to pixels in a pixel array in which rasters in which a plurality of pixels are lined up in a first direction are lined up in a second direction that is orthogonal to the first direction and applying ink dots to the recording medium by applying ink which includes a color material that is coagulated using an action of the reaction liquid to the pixels of the pixel array, in which the dots of the reaction liquid are separated by one pixel or more in the first direction and the second direction.

In the aspects of the invention configured in this manner (printing apparatus and printing method), the dots of the reaction liquid are applied to the recording medium by applying the reaction liquid to pixels in the pixel array in which the rasters in which the plurality of pixels are lined up in the first direction are lined up in the second direction. At this time, the reaction liquid dots are applied to the recording medium while being separated by one pixel or more in the first direction and the second direction. As a result, it is possible to suppress the reaction liquid dots that are applied to the recording medium converging into a cluster.

In addition, a gap between pixels to which the reaction liquid dots lined up in the first direction or the second direction are applied may be configured such that there are two pixels or three or more pixels. Due to this, it is possible to more reliably suppress the reaction liquid dots that are applied to the recording medium converging into a cluster.

In addition, the gap between pixels to which the reaction liquid dots lined up in the first direction or the second direction are applied may be configured such that there are seven or less pixels. Due to this, it is possible to suppress fixability of the ink from being impaired as a result of the amount of the reaction liquid that is applied to the recording medium being too little.

In addition, there may be a configuration including a memory portion that stores mask data that indicates the plurality of pixels that are separated from each other by one or more pixels in the first direction and the second direction as a pixel candidate to which the reaction liquid is applied and a control portion which generates second dot data according to a logical product of the mask data and first dot data while generating the first dot data that indicates the pixel to which the ink dots are applied, in which the ink application portion applies the reaction liquid dots to be separated from each other by one or more pixels in the first direction and the second direction by applying the reaction liquid to the pixel which is indicated by the second dot data, and the ink application portion applies the ink dots to the pixel which is indicated by the first dot data. With this configuration, the reaction liquid is selectively discharged with respect to the pixels on which the ink is discharged, and the reaction liquid is not discharged with respect to the pixels on which the ink is not discharged. Accordingly, it is possible to suppress consumption of the reaction liquid.

In addition, there may be a configuration in which the control portion controls the reaction liquid application portion based on a result in which a first region in which an image of a specific pattern is printed and a second region in which an image of a pattern that is different from the specific pattern is printed are recognized, and the reaction liquid application portion applies the reaction liquid dots to the pixel which is indicated by the second dot data with respect to the first region and applies the reaction liquid dots to the pixel which is indicated by the first dot data with respect to the second region. With this configuration, it is possible to adjust the gap at which the reaction liquid is applied according to the pattern of the printed image.

In detail, there may be a configuration in which the image of the specific pattern is a ruled line image. Due to this, it is possible to suppress generation of defects in which the ruled line image becomes partially thick caused by the reaction liquid dots that are applied to the recording medium converging into a cluster.

Note that, since not all of a plurality of configuring elements that each aspect of the invention described above has are essential and in order to solve a part or all of the problems described above, or in order to achieve a part or all of the effects described in the specification, as appropriate, modification, deletion, replacement with a new other configuring element, and partial deletion of limited content of a part of the configuring elements of the plurality of configuring elements, may be performed. In addition, in order to solve a part or all of the problems described above, or in order to achieve a part or all of the effects described in the specification, the independent inventions may be formed as one by combining a part or all of technical characteristics that are included in one form of the invention described above and a part or all of the technical characteristics which are included in another form of the invention described above.

BRIEF DESCRIPTION OF THE DRAWINGS

Embodiments of the invention will now be described by way of example only with reference to the accompanying drawings, wherein like numbers reference like elements.

DESCRIPTION OF EXEMPLARY EMBODIMENTS

Figure 1:
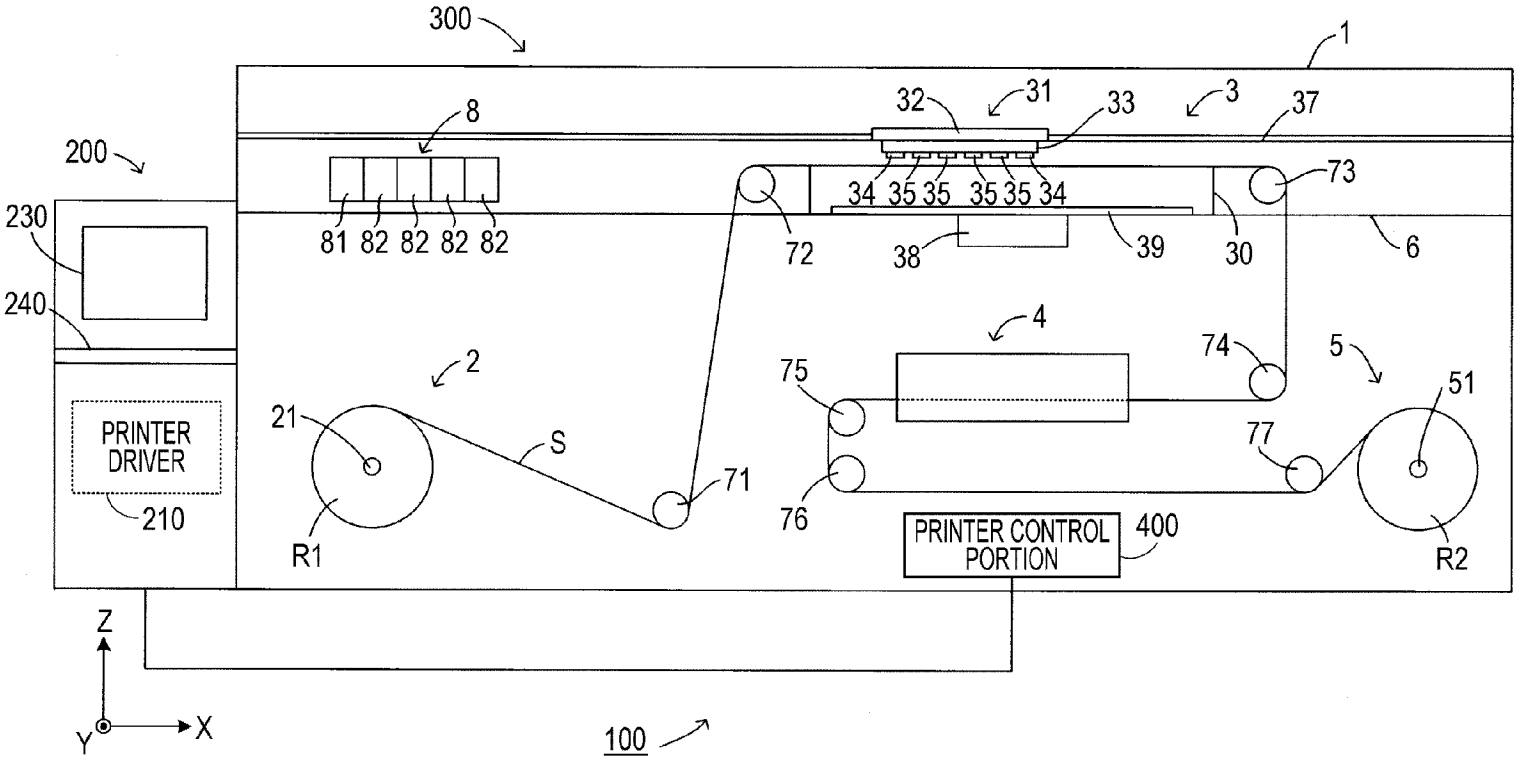
FIG. 1 is a front surface view schematically illustrating an example of a printing apparatus to which the invention is applied.

FIG. 1 is a front surface view schematically illustrating an example of a printing apparatus to which the invention is applied. Note that, XYZ orthogonal coordinates are described together where the Z axis is a vertical axis in order to clarify a disposition relationship of each portion of the apparatus according to need using FIG. 1 and the subsequent drawings. In the description below, a positive direction that is a direction in which (arrows of) each coordinate axis faces and a negative direction that is an opposite direction thereto are appropriately handled.

A printing apparatus 100 is provided with a host device 200 that generates printing data from image data (e.g. heat map data) which is received from an external device such as a personal computer and a printer 300 that prints an image based on the printing data which is received from the host device 200. The printer 300 prints the image on a front surface of a long sheet S using an ink jet method while transporting the sheet S roll-to-roll.

As shown in FIG. 1, the printer 300 is provided with a main body casing 1 that has a substantially rectangular shape. A feeding portion 2 that feeds the sheet S from a roll R1 on which the sheet S is wound, a printing chamber 3 that performs printing by discharging ink onto the front surface of the wound sheet S, a drying portion 4 that dries the sheet S onto which the ink is adhered, and a winding portion 5 that winds the sheet S after drying as a roll R2 are disposed inside the main body casing 1.

In further detail, the inside of the main body casing 1 is partitioned vertically in a Z axis direction using a flat plate form base 6 which is disposed parallel to (that is, horizontal to) the XY horizontal plane, and an upper side of the base 6 is set as the printing chamber 3. In a substantially center portion within the printing chamber 3, a platen 30 is fixed to the upper surface of the base 6. The platen 30 has a rectangular shape, and the sheet S is supported from the lower side using the upper surface parallel to the XY horizontal plane. Then, printing is performed by a recording unit 31 with respect to the sheet S that is supported on the platen 30.

Meanwhile, the feeding portion 2, the drying portion 4, and the winding portion 5 are disposed on the lower side of the base 6. The feeding portion 2 is disposed on the lower side (obliquely down leftward in FIG. 1) in the X axis negative direction with respect to the platen 30, and is provided with a rotatable feeding shaft 21. Then, the roll R1 is supported by the sheet S being wound on the feeding shaft 21. Meanwhile, the winding portion 5 is disposed on the lower side (obliquely down rightward in FIG. 1) in the X axis positive direction with respect to the platen 30, and is provided with a rotatable winding shaft 51. Then, the roll R2 is supported by the sheet S being wound on the winding shaft 51. In addition, the drying portion 4 is disposed directly below the platen 30 between the feeding portion 2 and the winding portion 5 in the X axis direction.

Then, the sheet S that is fed from the feeding shaft 21 of the feeding portion 2 is wound on the winding shaft 51 of the winding portion 5 after passing through the printing chamber 3 and the drying portion 4 in order while being guided by rollers 71 to 77. That is, the rollers 72 and 73 are disposed lined up (that is horizontally) straight in the X axis direction so as to interpose the platen 30, and their respective top portions are positionally adjusted so as to have the same height as the upper surface (surface which supports the sheet S) of the platen 30. Accordingly, the sheet S that is wound on the roller 72 is moved horizontally (X axis direction) while in sliding contact with the upper surface of the platen 30 up to reaching the roller 73.

In the printing chamber 3, the printing process on the sheet S is executed by the recording unit 31 that is disposed on the upper surface of the platen 30. The recording unit 31 prints the image on the sheet S by discharging the ink on the sheet S after reaction liquid is discharged on the sheet S. That is, a cartridge mounting portion 8 is provided on an end portion (left end portion in FIG. 1) in the X axis negative direction within the printing chamber 3, and a reaction liquid cartridge 81 which retains the reaction liquid and a plurality of ink cartridges 82 which retain the ink of colors that are different from each other are mounted in the cartridge mounting portion 8 to be attachable and detachable. Then, the recording unit 31 is able to discharge the reaction liquid that is supplied from the reaction liquid cartridge 81 and the ink that is supplied from the ink cartridge 82 on the sheet S by respective ink jet methods.

That is, in the reaction liquid, a coagulant, which coagulates a color material that is included in the ink, is dissolved in a solvent. It is possible to suitably use a multivalent metal salt as the coagulant. It is possible to suitably use one or a plurality out of, for example, calcium nitrate, calcium chloride, magnesium chloride, calcium acetate, magnesium acetate, and calcium formate as the multivalent metal salt. In addition, it is preferable to use water as the solvent of the reaction liquid, a water-soluble organic solvent such as a polyhydric alcohol and a polyhydric alcohol derivative may be added in addition to the water.

Figure 2:
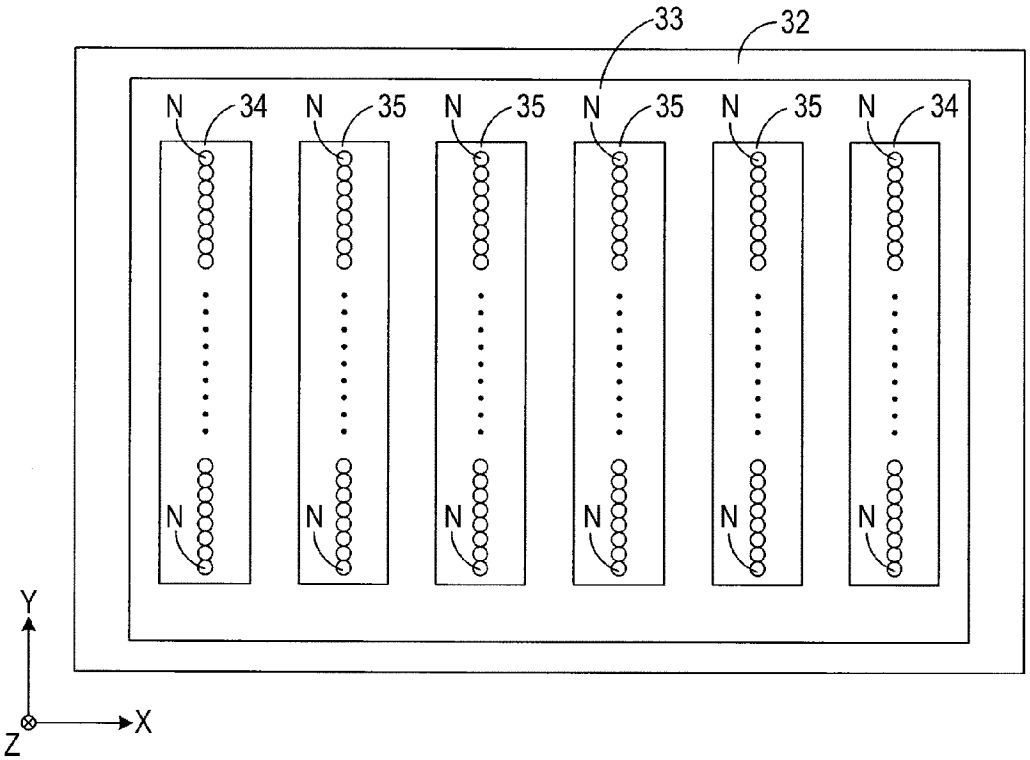
FIG. 2 is a bottom surface view partially illustrating a configuration of a recording unit.

FIG. 2 is a bottom surface view partially illustrating a configuration of a recording unit. Here, details of the recording unit 31 will be described using FIGS. 1 and 2. The recording unit 31 has a carriage 32, a flat plate form support plate 33 that is attached to the lower surface of the carriage 32, and recording heads 34 and 35 that are attached to the lower surface of the support plate 33. On the lower surface of the support plate 33, one recording head 34, four recording heads 35, and one recording head 34 are lined up at an equal pitch in the X axis direction and a plurality of nozzles N are lined up parallel to the Y axis direction in each recording head 34 and 35. Then, the respective recording heads 34 on both ends discharge the reaction liquid from the nozzles N, and the four recording heads 35 that are disposed between the recording heads 34 respectively discharge ink of colors that are different from each other from the nozzles N.

The description will continue returning to FIG. 1. The carriage 32 of the recording unit 31 that is configured as described above is integrally movable with the support plate 33, and the recording heads 34 and 35. That is, inside the printing chamber 3, when an X axis guide rail 37 is provided to extend parallel to the X axis direction and the carriage 32 receives driving force of an X axis motor Mx (FIG. 3), the carriage 32 moves in the X axis direction along the X axis guide rail 37. Furthermore, inside the printing chamber 3, when a Y axis guide rail (omitted in the illustration) is provided to extend parallel to the Y axis direction and the carriage 32 receives driving force of a Y axis motor My (FIG. 3), the carriage 32 moves in the Y axis direction along the Y axis guide rail.

Then, printing is executed by a lateral scan method described, for example, in JP-A-2013-000997 and the like. According to the method, printing is executed by two-dimensionally moving the carriage 32 of the recording unit 31 in the XY surface with respect to the sheet S that stops on the upper surface of the platen 30. In detail, the recording unit 31 executes an operation (main scanning) in which the ink is discharged on the sheet S from each nozzle N of the recording heads 35 while moving the carriage 32 in the X axis direction (main scanning direction). In the main scanning, a two dimensional image is printed by lining up a plurality of images per one line (line images) that extend in the X axis direction which is formed by the ink that is discharged by one nozzle N while spacing at intervals in the Y axis direction. Then, main scanning of a plurality of times is executed by alternately executing the main scanning and sub-scanning in which the carriage 32 is moved in the Y axis direction (sub-scanning direction).

That is, when the recording unit 31 completes main scanning of one time, the recording unit 31 moves the carriage 32 in the Y axis direction by performing sub-scanning. Subsequently, the recording unit 31 moves the carriage 32 in the X axis direction (opposite orientation to the main scanning of a tip) from a position that is moved by sub-scanning. Due to this, the line image is formed by new main scanning between each of the plurality of line images which are formed already by the main scanning of the tip. Then, the printer 300 executes the main scanning a plurality of times while reciprocally moving the carriage 32 and prints the image per one frame by alternately executing the main scanning and the sub-scanning.

In particular, in each main scan of the embodiment, the reaction liquid is discharged from the recording heads 34 that are positioned at a head of the carriage 32 in the movement direction. That is, the recording heads 34 discharge the reaction liquid with respect to a prearranged position (pixel) of discharge of the ink by each recording head 35 on the downstream side in the movement direction in the main scanning during execution. Accordingly, the color material of the ink in each line image that is printed in the main scanning is fixed to the sheet S by coagulating by the action of the reaction liquid that is discharged in advance on the sheet S.

Printing of one frame as described above is repeatedly executed while intermittently moving the sheet S in the X axis direction. In detail, the predetermined range across substantially the entire region of the platen 30 on the upper surface is a printing region. Then, printing of one frame is performed on the sheet S that is stopped on the upper surface of the platen 30 during intermittent transport while the sheet S is intermittently transported in the X axis direction with a distance (intermittent transport distance) that corresponds to the length of the printing region in the X axis direction as a unit. In other words, when printing of one frame ends on the sheet S that stops on the platen 30, the sheet S is transported in the X axis direction by the intermittent transport distance and an unprinted surface of the sheet S stops on the platen 30. Subsequently, printing of one frame is newly executed on the unprinted surface, and when printing ends, the sheet S is transported again in the X axis direction by the intermittent transport distance. Then, the series of operations are repeatedly executed.

Note that, since the sheet S that stops on the upper surface of the platen 30 during intermittent transport is kept flat, the platen 30 is provided with a mechanism that suctions the sheet S that stops on the upper surface. In detail, multiple suction holes which are not shown in the drawings are open on the upper surface of the platen 30, and a suction portion 38 is attached to the lower surface of the platen 30. Then, by the suction portion 38 operating, negative pressure is generated in the suction hole on the upper surface of the platen 30 and the sheet S is suctioned on the upper surface of the platen 30. Then, while the sheet S for printing is stopped on the platen 30, the sheet S is kept flat by the suction portion 38 suctioning the sheet S. Meanwhile, when printing ends, it is possible to smoothly transport the sheet S by the suction portion 38 stopping the suction of the sheet S.

Furthermore, a heater 39 is attached on the lower surface of the platen 30. The heater 39 heats the platen 30 at a predetermined temperature (for example, 45 degrees). Thereby, the sheet S is primarily dried by heat of the platen 30 while receiving the printing process using the recording heads 34 and 35. Then, drying of the reaction liquid or the ink that is landed on the sheet S is promoted by the primary drying.

By doing this, the sheet S that is primarily dried while receiving printing of one frame moves from the platen 30 to the drying portion 4 with the intermittent transport of the sheet S. The drying portion 4 executes the drying process in which the reaction liquid or the ink that is landed on the sheet S is completely dried by air that is heated using drying. Then, the sheet S that receives the drying process reaches the winding portion 5 with the intermittent transport of the sheet S and is wound as the roll R2.

Figure 3:
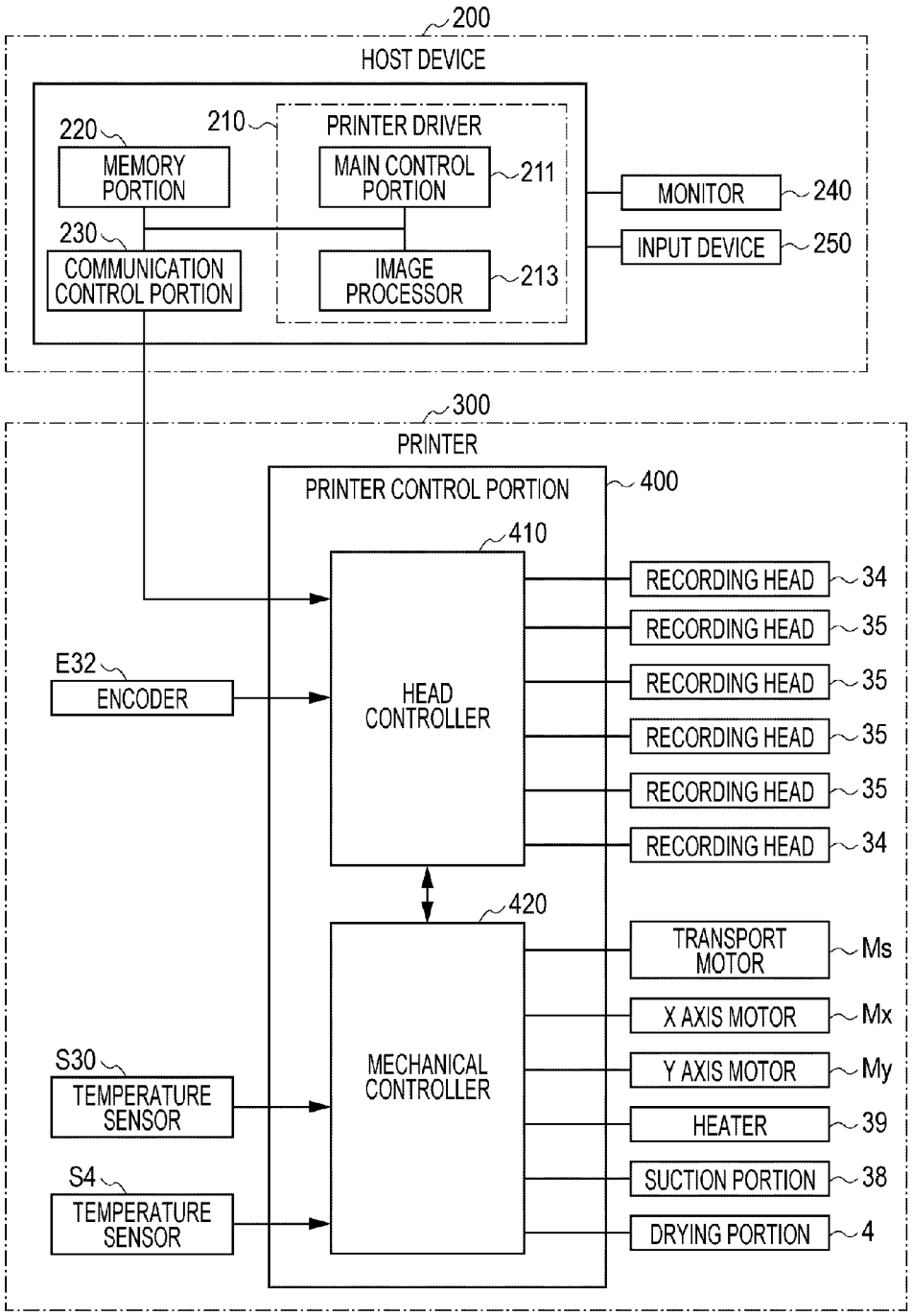
FIG. 3 is a block diagram schematically illustrating an electrical configuration in which a printing apparatus in FIG. 1 is provided.

Above is a summary of a mechanical configuration that the printing apparatus 100 is provided with. Subsequently, in addition to FIG. 1 described above, FIG. 3 describes an electrical configuration which is provided with the printing apparatus 100 in FIG. 1. Here, FIG. 3 is a block diagram schematically illustrating the electrical configuration in which a printing apparatus in FIG. 1 is provided.

As described above, the printing apparatus 100 is provided with the host device 200 that controls the printer 300. The host device 200 is configured, for example, by a personal computer, and is provided with a printer driver 210 that controls operation of the printer 300. That is, the printer driver 210 is constructed by a central processing unit (CPU), which is provided in the host device 200, executing a program for the printer driver 210. Furthermore, the host device 200 is provided with a memory portion 220 that is configured by a random access memory (RAM), a hard disk drive (HDD), or the like, and a communication control portion 230 that governs a communication function of the printer 300.

In addition, the host device 200 is provided with a monitor 240 that is configured by a liquid crystal display and the like and an input device 250 that is configured by a keyboard, mouse, or the like as an interface with an operator. That is, the monitor 240 and the input device 250 may be integrally configured by a touch panel display. A menu screen in another image that is a target for printing is displayed on the monitor 240. Accordingly, the operator is able to set various printing conditions such as a type of the sheet S, a size of the sheet S, printing quality, and a version number by opening a printing setting screen from the menu screen by operating the input device 250 while checking the monitor 240.

The printer driver 210 has a main control portion 211, and the main control portion 211 controls display of the monitor 240 and an input process from the input device 250. In detail, the main control portion 211 displays various screens such as the menu screen or the printing setting screen on the monitor 240 and performs a process according to content that is input from the input device 250 on various screens. Thereby, the main control portion 211 generates a necessary control signal for controlling the printer 300 according to input from the operator.

Furthermore, the printer driver 210 has an image processor 213 that executes image processing with respect to image data that is received from the external device. The image processor 213 generates printing data that is necessary for driving the recording heads 34 for the reaction liquid or the recording heads 35 for the ink according to the image data. Note that, detailed description of a method for generating printing data from the image data will be described later.

Then, the control signal that is generated by the main control portion 211 or the printing data that is generated by the image processor 213 are transferred to a printer control portion 400 that is provided within the main body casing 1 of the printer 300 via the communication control portion 230. The communication control portion 230 is able to perform two-way serial communication with the printer control portion 400, the control signal or the printing data is transferred to the printer control portion 400, and a response signal thereof is received from the printer control portion 400 and transmitted to the main control portion 211.

The printer control portion 400 is provided with a head controller 410 and a mechanical controller 420. The head controller 410 governs a function of controlling the recording heads 34 and 35 based on the printing data that is transmitted from the printer driver 210. In detail, the head controller 410 controls discharge of the reaction liquid from the recording heads 34 and the ink from the recording heads 35 based on printing data. At this time, a timing at which the reaction liquid and the ink are discharged from the recording heads 34 and 35 is controlled based on movement of the carriage 32 in the X axis direction. That is, a linear encoder E32 that detects the position of the carriage 32 in the X axis direction is provided inside the printing chamber 3. Then, the head controller 410 discharges the reaction liquid or the ink from the recording heads 34 and 35 at a timing according to movement of the carriage 32 in the X axis direction by referencing output of the linear encoder E32.

Meanwhile, the mechanical controller 420 mainly governs the function of controlling intermittent transport of the sheet S or driving of the carriage 32. In detail, the mechanical controller 420 executes intermittent transport of the sheet S by controlling a transport motor Ms which drives a sheet transport system that is configured by the feeding portion 2, the rollers 71 to 77, and the winding portion 5. In addition, the mechanical controller 420 executes movement in the X axis direction for main scanning in the carriage 32 by controlling the X axis motor Mx and executes movement in the Y axis direction for sub-scanning in the carriage 32 by controlling the Y axis motor My.

Furthermore, the mechanical controller 420 is able to execute various control other than the control described above for the printing process. For example, the mechanical controller 420 executes temperature control such as carrying out feedback control on the heater 39 based on output of a temperature sensor S30 which detects temperature on the upper surface of the platen 30 and carrying out feedback control on the drying portion 4 based on output of a temperature sensor S4 which detects temperature inside the drying portion 4.

Above is a summary of a mechanical configuration that the printing system in FIG. 1 is provided with. Note that, in the printing apparatus 100 in which the reaction liquid is used as described above, the printing process is executed by discharging the ink after the reaction liquid is discharged in advance onto the sheet S. In addition, discharge of the reaction liquid with respect to prearranged discharge of the ink onto all pixels is considered to be an ink discharge form. However, in a case where the reaction liquid is discharged in such a discharge form, a phenomenon such as indicated in FIGS. 4 and 5 may occur.

Figure 4:
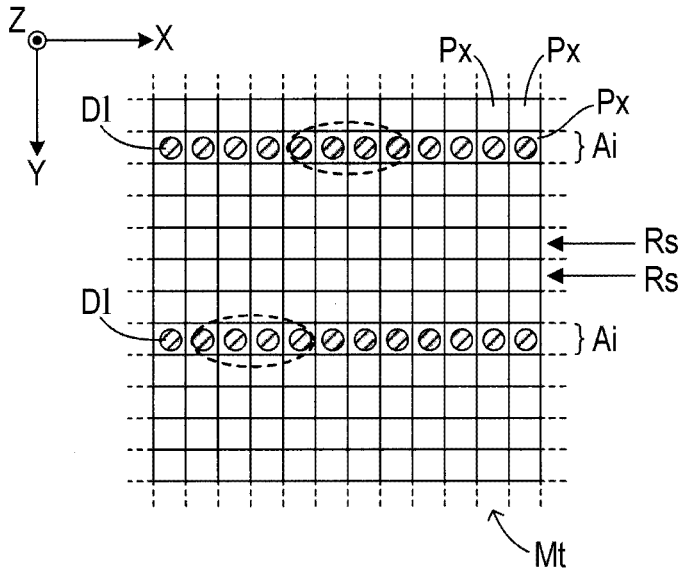
FIG. 4 is a diagram schematically illustrating an example of a discharge form of reaction liquid in a case of printing a ruled line image.
Figure 5:
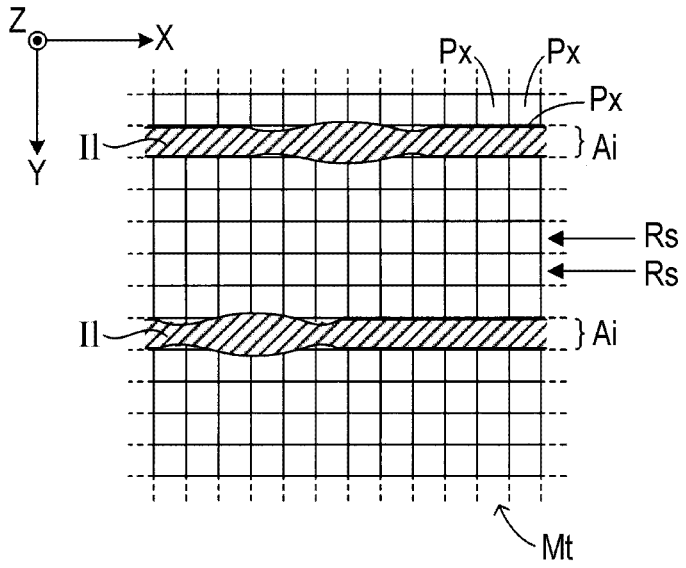
FIG. 5 is a diagram schematically illustrating an example of the ruled line image in a case of discharging the reaction liquid in the discharge form in FIG. 4.

FIG. 4 is a diagram schematically illustrating an example of the discharge form of the reaction liquid in a case of printing the ruled line image, and FIG. 5 is a diagram schematically illustrating an example of the ruled line image in a case of discharging the reaction liquid in the discharge form in FIG. 4. As shown in FIGS. 4 and 5, the printing apparatus 100 executes the printing process by virtually setting a pixel matrix Mt in which a plurality of pixels Px are virtually arranged in a matrix shape on the front surface of the sheet S. In the pixel matrix Mt, the plurality of pixels Px are lined up in parallel to the X axis direction (main scanning direction) to form a plurality of rasters Rs, and the plurality of rasters Rs are lined up in parallel with each other in the Y axis direction (sub-scanning direction). In this manner, in the pixel matrix Mt, the plurality of pixels Px are lined up in parallel to the X axis direction, and the plurality of pixels Px are lined up in parallel to the Y axis direction.

Then, in this example, reaction liquid dots Dl are discharged with respect to all pixels Px that belong to a prearranged ink discharge region Ai into which the ink for forming the ruled line image is discharged. Therefore, other reaction liquid dots Dl are adjacent in the X axis direction with respect to each reaction liquid dot Dl. As a result, the plurality of the reaction liquid dots Dl that are adjacent to each other may converge into a large cluster. Then, for example, in a case where convergence of the reaction liquid dots Dl occurs in a range that is enclosed by a dashed line ellipse in FIG. 4, as shown in FIG. 5, a phenomenon in which the width of a ruled line image Il becomes partially thick may occur. Note that, FIGS. 4 and 5 indicate a case where two reaction liquid dots Dl are adjacent in the X axis direction, but a similar phenomenon also occurs in a case where the two reaction liquid dots Dl are adjacent in the Y axis direction.

Figure 6:
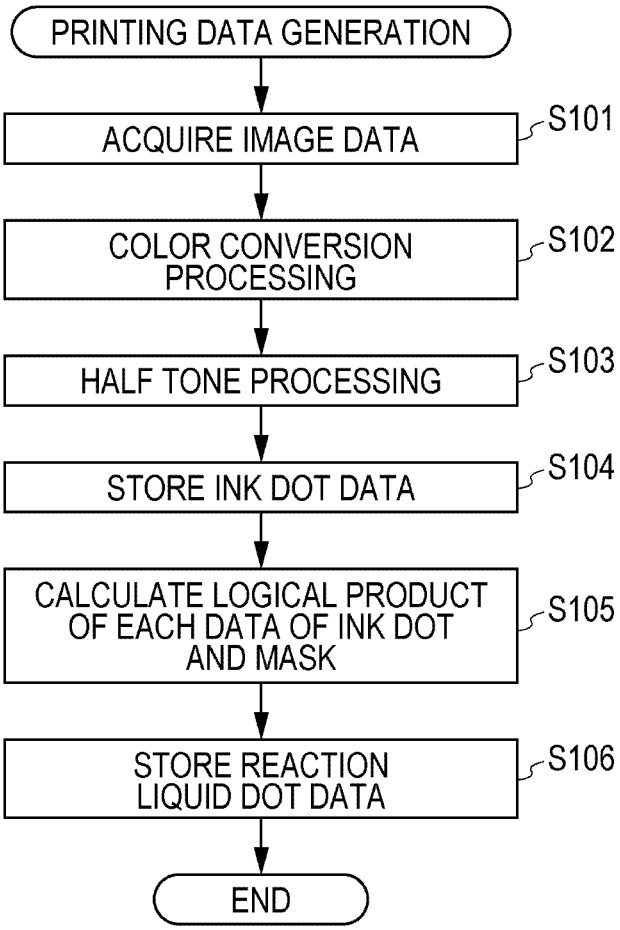
FIG. 6 is a flow chart illustrating a first example of printing data generation.

In contrast to this, if the printing data is generated by a method subsequently indicated, it is possible to discharge the reaction liquid in a form in which generation of the phenomenon is able to be suppressed. FIG. 6 is a flow chart illustrating a first example of printing data generation. The flow chart in FIG. 6 is executed by the printer driver 210 of the host device 200. In step S101, image data is received from an external apparatus and is stored in the memory portion 220. Then, the image processor 213 executes color conversion processing (image processing) on the image data (step S102). That is, the image data that is received from the external device is configured by three color components of R, G, and B, and a pixel value of each pixel Px is represented by multiple tones (for example, 256 tones). Therefore, the image processor 213 executes on the image data color conversion processing that converts each component of R, G, and B on a plurality of color components (for example, Y, M, C, and K) that are able to be printed by the printer 300.

Furthermore, the image processor 213 executes halftone processing using a dither matrix with respect to the image data after color conversion processing. By half tone processing, the image data that represents the pixel value of each pixel Px in multiple tones is converted to ink dot data that is binary data which indicates presence or absence of discharge of ink dots on each pixel Px (step S103). Then, the ink dot data is stored in the memory portion 220 (step S104). Note that, as described above, in order to form a color image, the inks of different colors are discharged by the plurality of recording heads 35. In contrast to this, each of the plurality of recording heads 35 generate and store the ink dot data of corresponding colors.

Subsequently, the image processor 213 generates reaction liquid dot data that is binary data which indicates presence or absence of discharge of the reaction liquid to each pixel Px based on the ink dot data that is generated in step S103. Particularly in the present embodiment, mask data K that specifies the pixel Px that permits discharge of the reaction liquid dots Dl and the pixel Px that prohibits discharge of the reaction liquid dots Dl is stored in the memory portion 220, and generation of the reaction liquid dot data is executed using the mask data K (FIG. 7).

Figure 7:
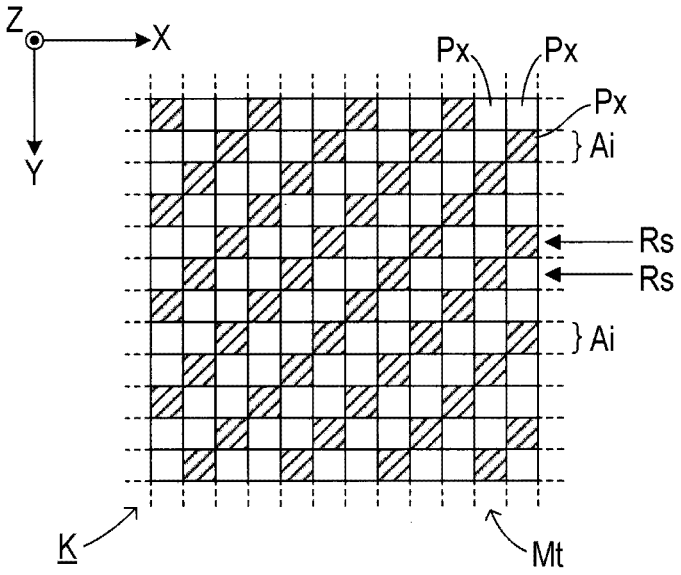
FIG. 7 is a diagram schematically illustrating an example of mask data.

FIG. 7 is a diagram schematically illustrating an example of mask data. In FIG. 7, the pixel Px which is hatched with diagonal lines is the pixel Px that permits discharge of the reaction liquid dots Dl (appropriately referred to as "permitting pixel Px") and the pixel Px which is white is the pixel Px that prohibits discharge of the reaction liquid dots Dl (appropriately referred to as "prohibiting pixel Px"). In the mask data K, the plurality of permitting pixels Px are discretely disposed one pixel at a time, and each permitting pixel Px is separated by one pixel or more and seven pixels or less from another permitting pixel Px in each direction of the X axis direction and the Y axis direction. In other words, one or more to seven or less of the prohibiting pixels Px are present between two permitting pixels Px that are lined up in parallel to the X axis direction, and one or more to seven or less pixels Px are present between two permitting pixels Px that are lined up in parallel to the Y axis direction. In detail, according to the mask data K, each permitting pixel Px is separated by two pixels in each direction of the X axis direction and the Y axis direction, and are continuous to a direction that is inclined at 45 degrees with respect to each of the X axis direction and the Y axis direction.

Then, the image processor 213 requests a calculation result of the logical product of the ink dot data and the mask data K as the reaction liquid dot data (step S105), and the data is stored in the memory portion 220 (step S106). That is, in steps S102 and S103, the ink dot data is requested per each of the plurality of colors in order to form a color image by discharging the ink of a plurality of colors. Therefore, in step S105, the result of the logical product of a logical sum of a plurality of sets of ink dot data that correspond to colors that are different from each other and the mask data K is requested as the reaction liquid dot data. In this manner, printing data that includes the ink dot data and the reaction liquid dot data is generated and printing data generation in FIG. 6 ends.

Figure 8:
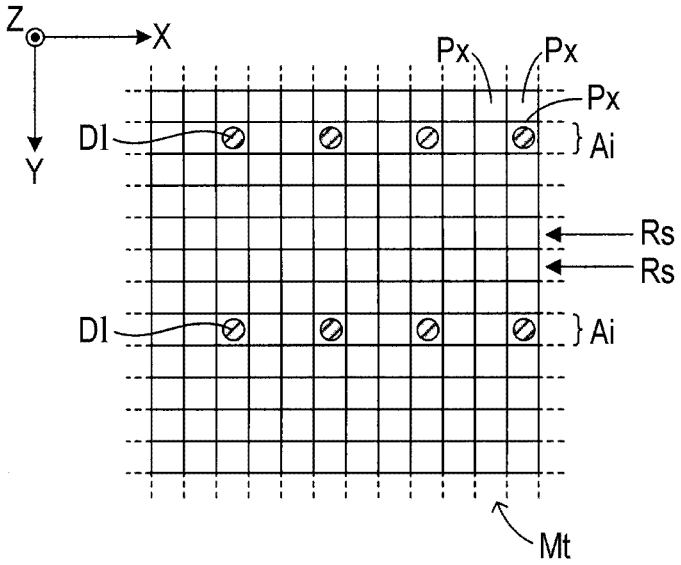
FIG. 8 is a diagram schematically illustrating an example in accordance with reaction liquid dot data that is generated according to FIG. 6.

FIG. 8 is a diagram schematically illustrating an example of a case in which the reaction liquid is discharged in accordance with the reaction liquid dot data that is generated by the flow chart in FIG. 6, and corresponds to a case in which the ruled line image that is indicated in FIG. 5 is printed. As shown in FIG. 8, in a case where the reaction liquid is discharged in accordance with the reaction liquid dot data that is requested in the manner described above, the ink dot data indicates discharge of the ink dots, and yet the reaction liquid dots Dl are discharged only on the pixels Px for which mask data K permits discharge of the reaction liquid dots Dl. As a result, each reaction liquid dot Dl is discharged on the sheet S so as to be separated by two or more pixels in the X axis direction and the Y axis direction. Subsequently, the ink is discharged with respect to the pixel Px for which the ink dot data indicates discharge of the ink dots.

In the embodiment as described above, the reaction liquid dots Dl are applied to the sheet S by applying the reaction liquid in which the raster Rs in which the plurality of pixels Px are lined up in the X axis direction to the plurality of pixels Px of the pixel matrix Mt that are lined up in the Y axis direction. At this time, the reaction liquid dots Dl are applied to the sheet S while being separated by one pixel or more in the X axis direction and the Y axis direction. As a result, it is possible to suppress reaction liquid dots Dl that are applied to the sheet S converging into a cluster.

In particular, the gap between the pixels Px to which the reaction liquid dots Dl that are lined up in the X axis direction or the Y axis direction are applied is two or more pixels. Due to this, it is possible to more reliably suppress the reaction liquid dots Dl that are applied to the sheet S converging into a cluster.

In addition, the gap between the pixels Px to which the reaction liquid dots Dl that are lined up in the X axis direction or the Y axis direction are applied is seven or less pixels. Due to this, it is possible to suppress fixability of the ink from being impaired since the amount of the reaction liquid that is applied to the sheet S is too little.

In addition, the mask data K that indicates the plurality of pixels Px that are separated from each other by one pixel or more in the X axis direction and the Y axis direction as the candidate of the pixel Px to which the reaction liquid is applied is stored in the memory portion 220. Then, the image processor 213 generates the ink dot data that indicates the pixels Px to which the ink dots are applied, and generates the reaction liquid dot data according to the logical product of the mask data K and the ink dot data. Then, the recording heads 34 apply the reaction liquid dots Dl to be separated from each other by one or more pixels in the X axis direction and the Y axis direction by applying the reaction liquid to the pixels Px which are indicated by the reaction liquid dot data, and the recording heads 35 apply the ink dots to the pixels Px which are indicated by the ink dot data. With this configuration, the reaction liquid is selectively discharged with respect to the pixels Px on which the ink is discharged, and the reaction liquid is not discharged with respect to the pixels Px on which the ink is not discharged. Accordingly, it is possible to suppress consumption of the reaction liquid.

Figure 9:
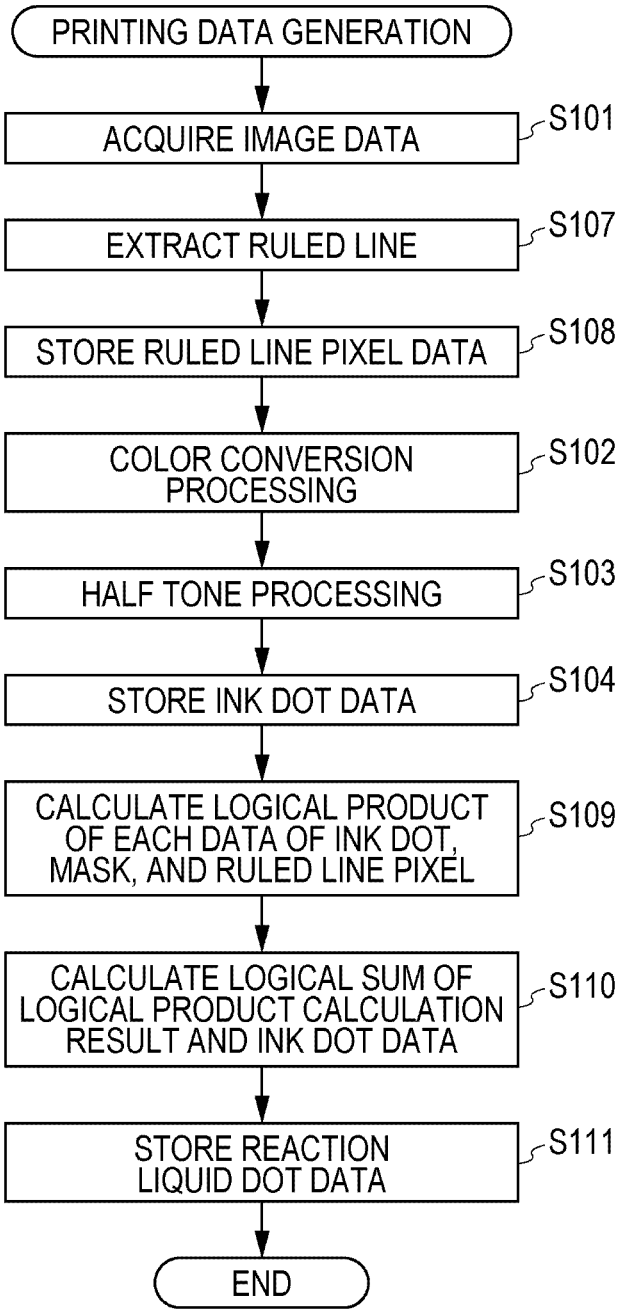
FIG. 9 is a flow chart illustrating a second example of printing data generation.

FIG. 9 is a flow chart illustrating a second example of printing data generation. The second example is different from the first example described above in a point in which discharge of the reaction liquid dots Dl is executed selectively using the mask data K with respect to only the ruled line image out of the entirety of the printing image. Therefore, below, the points of difference from the first example are described, and common points are given equivalent reference numerals and description is omitted as appropriate. However, needless to say, the same effects are exhibited by providing a configuration which is common to the first example.

In the second example, the ruled line image is extracted from the image data acquired by the image processor 213 in step S101 (step S107). In detail, edge detection using a Sobel filter is executed with respect to the image data. Then, out of the detected edges, an image that is spaced by a gap of a predetermined threshold width and enclosed by two straight line shape edges which extend parallel to each other is extracted as the ruled line image. Furthermore, the image processor 213 requests ruled line image data that indicates the pixels Px which are included in a region (ruled line region) in which the extracted ruled line image is printed and stores the data in the memory portion 220 (step S108).

Subsequently, in the same manner as in the first example, steps S102 to S104 are executed and the ink dot data is generated and stored. Then, the image processor 213 calculates the logical product of the ink dot data, the mask data K, and the ruled line image data. In the data that is obtained by the logical product, the ink dot data indicates discharge of the ink dots, and selectively discharges the reaction liquid dots Dl only with respect to the pixels Px for which the mask data K permits discharge of the reaction liquid dots Dl and yet that belong to the ruled line region. That is, the data is the reaction liquid dot data for a ruled line that indicates presence or absence of discharge of the reaction liquid dots Dl to each pixel Px that belongs to the ruled line region.

Then, the image processor 213 requests a calculation result of the logical product, that is, a result in which the logical sum of the reaction liquid dot data for the ruled line and the ink dot data outside of the ruled line region is calculated as the reaction liquid dot data (step S110), and the data is stored in the memory portion 220 (step S111). In this manner, concerning each pixel Px out of all the pixels that include the ruled line region and a region outside thereof (non-ruled line region), the reaction liquid dot data that indicates the presence or absence of discharge of the reaction liquid dots Dl is requested. Due to this, printing data that is configured by the ink dot data and the reaction liquid dot data is generated and printing data generation in FIG. 9 ends.

Then, the printer 300 executes the printing process based on the printing data. As a result, discharge of the reaction liquid from the recording heads 34 is controlled based on a result in which the ruled line region that prints the ruled line image and the non-ruled line region in which an image that is different from the ruled line image is printed are recognized. That is, with respect to the ruled line region, the reaction liquid dots Dl are discharged on the pixels Px for which the reaction liquid dot data for the ruled line that is calculated in step S109 indicates discharge of the dots, and with respect to the non-ruled line region, the reaction liquid dots Dl are discharged on the pixels Px for which the ink dot data indicates discharge of the dots. Due to this, it is possible to adjust the gap at which the reaction liquid is applied according to the pattern of the printed image.

In particular, with respect to the ruled line region, the reaction liquid dots Dl are discharged on the sheet S while being separated by one pixel or more in the X axis direction and the Y axis direction. As a result, it is possible to suppress generation of defects in which the ruled line image becomes partially thick by suppressing the reaction liquid dots Dl that are applied to the sheet S from converging into a cluster.

In this manner, in the present embodiment, the printing apparatus 100 is equivalent to an example of the "printing apparatus" of the invention, the recording head 34 is equivalent to an example of the "reaction liquid application portion" of the invention, the recording head 35 is equivalent to an example of the "ink application portion" of the invention, the sheet S is equivalent to an example of the "recording medium" of the invention, the pixel matrix Mt is equivalent to an example of the "pixel array" of the invention, the raster Rs is equivalent to an example of the "raster" of the invention, the pixel Px is equivalent to an example of the "pixel" of the invention, the X axis direction is equivalent to an example of the "first direction" of the invention, the Y axis direction is equivalent to an example of the "second direction" of the invention, the memory portion 220 is equivalent to an example of the "memory portion" of the invention, the main control portion 211 and the image processor 213 function together as an example of the "control portion" of the invention, the mask data K is equivalent to an example of the "mask data" of the invention, the ink dot data is equivalent to an example of the "first dot data" of the invention, the reaction liquid dot data is equivalent to an example of the "second dot data" of the invention, the ruled line is equivalent to an example of the "specific pattern" of the invention, the ruled line region is equivalent to an example of the "first region" of the invention, and the non-ruled line region is equivalent to an example of the "second region" of the invention.

Here, the invention is not limited to the embodiments described above, and it is possible to add various modifications with regard to the above description without deviating from the scope of the invention. For example, the configuration of the matrix data K may be appropriately modified. In detail, in the mask data K, the number of prohibiting pixels Px that are present in a gap by which each permitting pixel Px is separated in the X axis direction, in other words, between two permitting pixels Px that are lined up in the X axis direction may be one pixel or more and appropriate modifications are possible. In addition, the same applies for the Y axis direction.

Therefore, it is possible to appropriately modify the gap between the pixels Px to which the reaction liquid dots Dl that are lined up in the X axis direction or the Y axis direction are discharged, and for example, the gap may be three or more pixels. Due to this, it is possible to more reliably suppress the reaction liquid dots Dl that are applied to the sheet S converging into a cluster.

Figure 10:
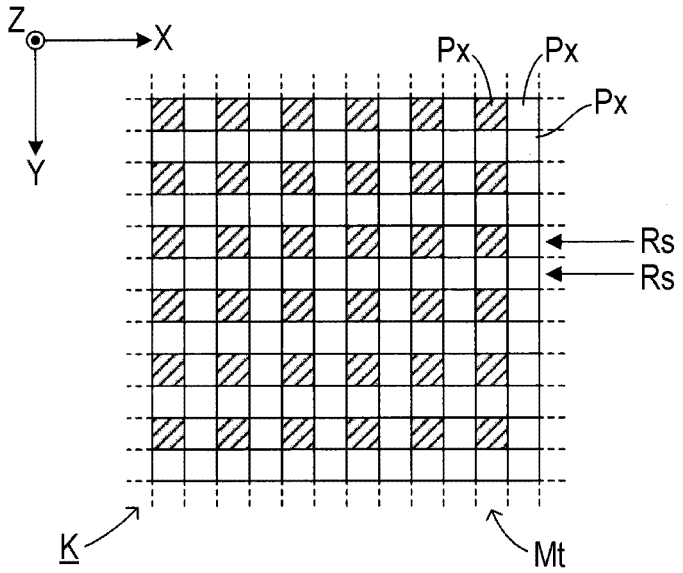
FIG. 10 is a diagram schematically illustrating a modification example of mask data.
Figure 11:
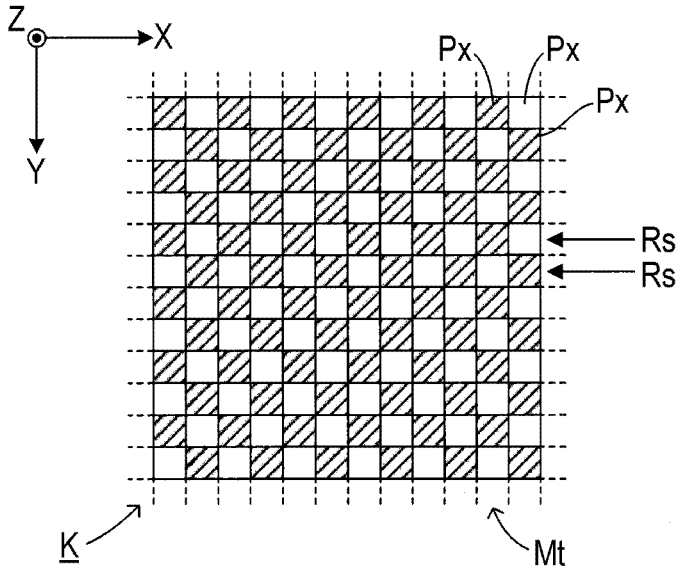
FIG. 11 is a diagram schematically illustrating another modification example of mask data.

Alternatively, it is also possible to configure the mask data K as indicated in, for example, FIG. 10 or 11. Here, FIG. 10 is a diagram schematically illustrating a modification example of the mask data, and FIG. 11 is a diagram schematically illustrating another modification example of the mask data. Note that, the representation in FIGS. 10 and 11 is the same as in FIG. 7. Using any mask data K, the reaction liquid dots Dl are applied to the sheet S while being separated by one pixel or more in the X axis direction and the Y axis direction. As a result, it is possible to suppress the reaction liquid dots Dl that are applied to the sheet S converging into a cluster.

In addition, in the example in FIG. 9, the reaction liquid is discharged in a discharge form in which the mask data K is selectively used with respect to the ruled line image. However, the reaction liquid may be discharged in a discharge form in which the mask data K is selectively used with respect to a pattern other than the ruled line, for example, an image such as an edge.

In addition, in the embodiment described above, the reaction liquid dot data is generated by calculating the logical product of the mask data K and the ink dot data. However, the mask data K may be adopted as the reaction liquid dot data without any changes without taking the logical product of the ink dot data. In this case, the reaction liquid dots Dl are discharged on each pixel Px onto which the mask data K permits discharge of the reaction liquid dots Dl.

In addition, a method in which the ruled line is extracted in step S107 in FIG. 9 is not limited to the example of the edge detection described above. Therefore, the ruled line may be extracted by a ruled line detection method described in JP-A-2008-257394.

In addition, the printer 300 described above discharges the reaction liquid or the ink from the recording heads 34 and 35 that move in the X axis direction with respect to the sheet S that intermittently stops on the flat plate form platen 30. However, as described in JP-A-2015-134460, it is not a problem if the printer 300 discharges the reaction liquid or the ink from the plurality of heads that are lined up along the peripheral surface of a rotation drum 30 while transporting the sheet S that is supported on the rotation drum 30 in a predetermined transport direction.

In addition, in the embodiment, the image per one frame is printed by alternately executing main scanning a plurality of times with sub-scanning. However, it is not a problem if the printer 300 is configured to print the image per one frame in main scanning of one time. In this case, the recording heads 34 and 35 are configured such that the plurality of nozzles N are lined up at an equal pitch in the Y axis direction according to resolution that is desired in the image, and it is possible to execute printing per one frame by discharging the reaction liquid and the ink from each nozzle N while moving the recording heads 34 and 35 in the X axis direction.

This application claims priority under 35 U.S.C. § 119 to Japanese Patent Application No. 2016-032730, filed Feb. 24, 2016. The entire disclosure of Japanese Patent Application No. 2016-032730 is hereby incorporated herein by reference.

What is claimed is:

1. A printing apparatus comprising:

a reaction liquid application portion that applies dots of reaction liquid onto a recording medium by applying the reaction liquid to pixels in a pixel array in which rasters in which a plurality of pixels are lined up in a first direction are lined up in a second direction which is orthogonal to the first direction; and an ink application portion that applies ink dots to the recording medium by applying ink which includes a color material that is coagulated using an action of the reaction liquid to the pixels of the pixel array, wherein at least part of the ink dots are applied to all of the dots of the reaction liquid when the ink dots are applied to the recording medium, wherein the reaction liquid application portion applies the reaction liquid dots so as to be separated by one pixel or more in the first direction and the second direction.

2. The printing apparatus according to claim 1, wherein a gap between pixels to which the reaction liquid dots lined up in the first direction or the second direction are applied is two pixels or three or more pixels.

3. The printing apparatus according to claim 2, wherein the gap between pixels to which the reaction liquid dots lined up in the first direction or the second direction are applied is seven pixels or less.

4. The printing apparatus according to claim 1, further comprising:

a memory portion that stores mask data which indicates the plurality of pixels that are separated from each other by one or more pixels in the first direction and the second direction as a pixel candidate to which the reaction liquid is applied; and a control portion which generates second dot data according to a logical product of the mask data and first dot data while generating the first dot data that indicates the pixel to which the ink dots are applied, wherein the ink application portion applies the reaction liquid dots to be separated from each other by one or more pixels in the first direction and the second direction by applying the reaction liquid to the pixel which is indicated by the second dot data, and the ink application portion applies the ink dots to the pixel which is indicated by the first dot data.

5. The printing apparatus according to claim 4, wherein the control portion controls the reaction liquid application portion based on a result in which a first region in which an image of a specific pattern is printed and a second region in which an image of a pattern that is different from the specific pattern is printed are recognized, and the reaction liquid application portion applies the reaction liquid dots to the pixel which is indicated by the second dot data with respect to the first region and applies the reaction liquid dots to the pixel which is indicated by the first dot data with respect to the second region.

6. The printing apparatus according to claim 5, wherein the image of the specific pattern is a ruled line image.

7. A printing method comprising:

applying dots of reaction liquid onto a recording medium by applying the reaction liquid to pixels in a pixel array in which rasters in which a plurality of pixels are lined up in a first direction are lined up in a second direction which is orthogonal to the first direction; and applying ink dots to the recording medium by applying ink which includes a color material that is coagulated using an action of the reaction liquid to the pixels of the pixel array, wherein at least part of the ink dots are applied to all of the dots of the reaction liquid when the ink dots are applied to the recording medium, wherein the reaction liquid dots are separated by one pixel or more in the first direction and the second direction.

* * * * *